US005911524A

United States Patent [19]

Wilton

[11] Patent Number: 5,911,524

[45] Date of Patent: Jun. 15, 1999

[54] AUTOMATED, ILLUMINATED ADDRESS DISPLAY AND ENTRANCE LIGHT

[76] Inventor: Timothy B. Wilton, 5505 Old Court Rd., Baltimore, Md. 21244

[21] Appl. No.: 09/115,968

[22] Filed: Jul. 15, 1998

[51] Int. Cl.[6] ..... G09F 13/04

[52] U.S. Cl. ..... 40/574; 40/564; 40/573; 362/276; 362/802

[58] Field of Search ..... 40/541, 564, 574, 40/570, 580, 568, 572, 573, 577, 716; 362/276, 802, 228, 234, 251

[56] References Cited

U.S. PATENT DOCUMENTS

| | | | |
|---|---|---|---|
| 1,709,202 | 4/1929 | Beldin | 40/564 |
| 3,590,507 | 7/1971 | Wren | 40/133 B |
| 4,009,535 | 3/1977 | Stock | 40/130 K |
| 4,254,457 | 3/1981 | Lordier | 362/367 |
| 4,272,901 | 6/1981 | Matthews | 40/574 |
| 4,373,284 | 2/1983 | Crane | 40/576 |
| 4,611,265 | 9/1986 | Davis | 362/145 |
| 4,807,378 | 2/1989 | Bell | 40/576 |
| 4,848,017 | 7/1989 | Bailey et al. | 40/576 |
| 4,854,062 | 8/1989 | Bayo | 40/551 |
| 4,937,499 | 6/1990 | Hunte | 40/568 X |
| 4,951,406 | 8/1990 | Lemire | 50/576 |
| 4,969,282 | 11/1990 | Eberhart | 40/541 X |
| 5,048,210 | 9/1991 | Taylor et al. | 40/575 |
| 5,305,979 | 4/1994 | Hanson | 248/291 |
| 5,408,773 | 4/1995 | Hwang | 40/547 |
| 5,434,764 | 7/1995 | Lee et al. | 362/276 |
| 5,435,087 | 7/1995 | Karkar et al. | 40/564 X |
| 5,454,181 | 10/1995 | Rothman et al. | 40/564 |
| 5,649,378 | 7/1997 | Roesser et al. | 40/559 |
| 5,729,924 | 3/1998 | Reading | 40/564 |

*Primary Examiner*—Brian K. Green
*Assistant Examiner*—Rodrigo J. Morales
*Attorney, Agent, or Firm*—Larry J. Guffey

[57] ABSTRACT

An automated, illuminated address display and entrance light for mounting on the exterior of and near the entrance of a building to enable a visitor during periods of darkness to locate and have the entrance to the building illuminated upon the visitor's approach to the building is disclosed. In a preferred embodiment, it comprises: (1) a housing having an interior panel that separates the housing into a front and a rear compartment, with the housing having transparent top, bottom and front surfaces, (2) a first hinge that allows the interior panel to be folded forward to allow access to the rear compartment behind the panel, (3) a second hinge that allows the front surface to be folded outwardly thereby providing room so that the interior panel can be folded forward, (4) a first light source mounted in the rear compartment to provide light that passes through the transparent top and bottom surfaces to illuminate the area around the housing, (5) a second light source mounted to the front surface of the interior panel for illuminating the housing front surface, (6) an electrical control circuit for turning on and off these lights, and (7) address indicia on the housing's transparent front surface.

19 Claims, 3 Drawing Sheets

AUTOMATED, ILLUMINATED ADDRESS DISPLAY AND ENTRANCE LIGHT

BACKGROUND OF THE INVENTION

1. Field of the Invention

The present invention generally relates to illumination devices. More particularly, this invention relates to devices for illuminating a house address display, which is mounted near the house's entrance, so as to facilitate the display's observation from the adjoining street, while also automatically illuminating the area around the house's entrance in response to detecting the motion of someone approaching the house's entrance.

2. Description of the Related Art

Identifying houses by their street number or other identification and illuminating the entrances to houses during night-time hours have been long-standing problems. House numbers and the like are generally attached on or in the vicinity of the front door of a house, but few of these numbers are illuminated so as to facilitate their observation at night. Meanwhile, houses often have entrance lights near their front doors, but these lights frequently are not illuminated at night when one approaches such front doors.

Many U.S. patents have been directed to providing devices for illuminating house-identifying information. For example, U.S. Pat. Nos. 3,590,507, 4,009,535, 4,254,457, 4,373,284, 4,611,265, 4,807,378, 4,848,017, 4,854,062, 4,901,461, 4,951,406, 5,048,210, 5,305,979, 5,408,733 and 5,649,378. However, none of these disclose a device capable of automatically illuminating both house-identifying information and the area in the vicinity of where this information is mounted.

Despite this prior art, the need exists for an improved means for illuminating a house address display which is mounted near the house's entrance so as to facilitate the display's observation from the street, while also automatically illuminating the area around the house's entrance in response to detecting the motion of someone approaching the house's entrance.

SUMMARY OF THE INVENTION

The present invention is generally directed to satisfy the needs set forth above and the problems identified in the prior art. The problem of automatically illuminating both house-identifying information and the area in the vicinity of where this information is mounted is resolved by the present invention.

In accordance with one preferred embodiment of the present invention, the foregoing need can be satisfied by providing an automated, illuminated address display and entrance light comprising:

- a housing having an interior panel that separates the housing into a front and a rear compartment, said housing having transparent top, bottom and front surfaces,
- a panel hinge attached respectively to an edge of said interior panel and an edge chosen from the group consisting of said housing bottom and top surfaces so as to allow said panel to be folded forward to allow access to the rear compartment behind the panel,
- a front surface hinge attached respectively to an edge of said front surface and an edge chosen from the group consisting of said housing bottom and top surfaces so as to allow said front surface to be folded outwardly thereby providing room so that said interior panel can be folded forward,

- a first light source mounted in said rear compartment to provide light that passes through the transparent top and bottom surfaces to illuminate the area around the housing,
- a second light source mounted to the front surface of said interior panel for illuminating said housing front surface,
- an electrical control circuit for turning on and off said first and second lights, and
- address indicia on said housing transparent front surface.

In another preferred embodiment, the present invention further includes the control circuit having a motion detector switch, connected to the first light source and for automatically turning on the first light source when there is motion in the region scanned by the motion detector, and a photo cell switch, connected to the second light source for automatically turning on the second light source in response to darkness created by the sun's setting and turning off the second light source in response to a general level of illumination associated with the sun's rising.

This new and improved, automated, illuminated address display and entrance light is seen to achieve its object of automatically illuminating both house-identifying information and the area in the vicinity of where this information is mounted.

Other objects and advantages of this invention will become readily apparent as the invention is better understood by reference to the accompanying drawings and the detailed description that follows.

DESCRIPTION OF THE PREFERRED EMBODIMENT

Figure 1:
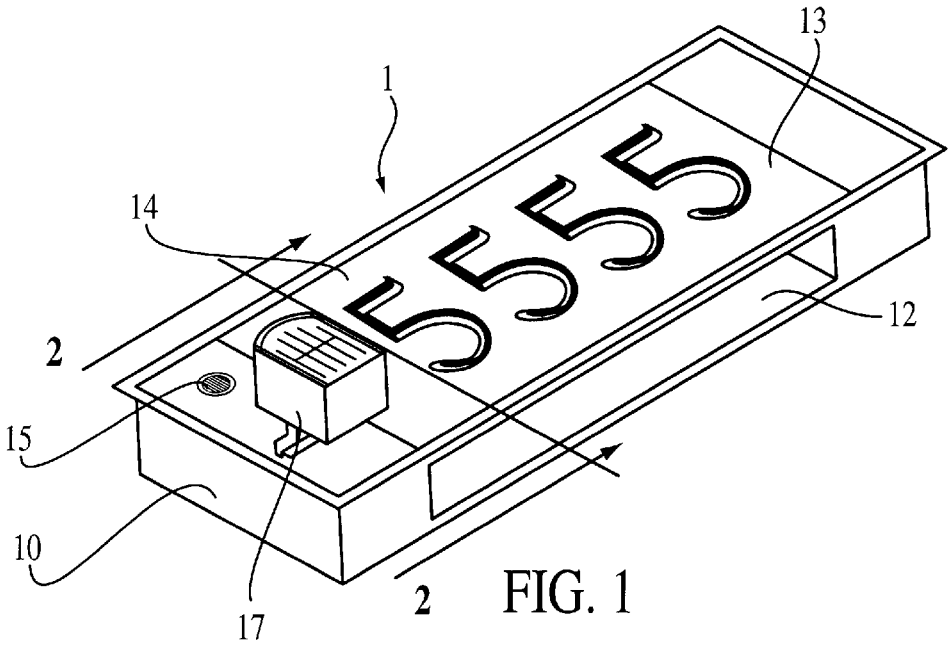
FIG. 1 is an exterior perspective view showing one embodiment of the present invention.

Referring now to the drawings wherein are shown preferred embodiments and wherein like reference numerals designate like elements throughout, there is shown in FIG. 1 an exterior perspective view showing one embodiment of the present invention for mounting on the exterior of and near the entrance of a building to enable a visitor during periods of darkness to locate and have the entrance to the building illuminated upon the visitor's approach to the building.

As shown in FIG. 1, the automated, illuminated address display and entrance light 1 comprises a rectangular housing 10 have a transparent top 11, bottom 12 and front 13 surfaces, address indicia 14 on the transparent front surface 13, a motion detector switch 15 for automatically turning on/off a first light source 16 that shines through the transparent top 11 and bottom 12 surfaces to illuminate the area around a building's entrance, and a photo cell switch 17 for automatically turning on/off a second light source 18 that illuminates the transparent front surface 13 after dark so that the building's address indicia may be seen and read.

Figure 2:
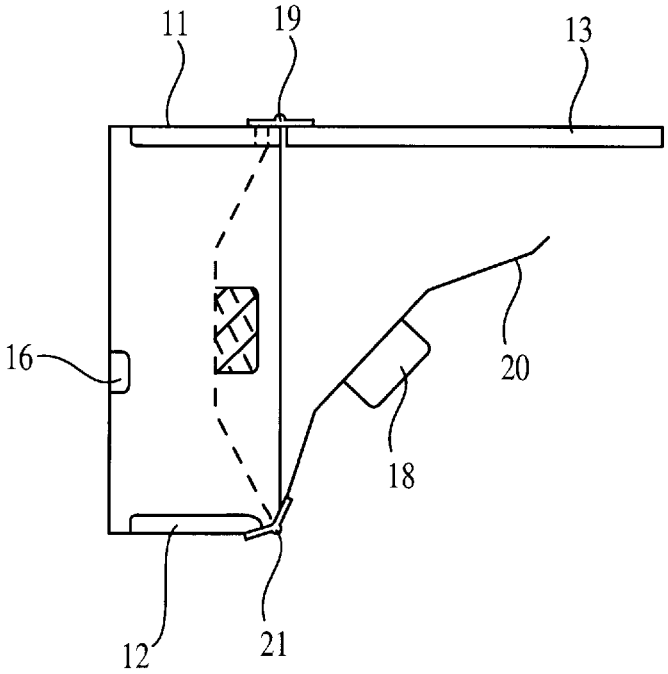
FIG. 2 is a side view taken on the line 2—2 of FIG. 1 showing the interior of the housing in full lines with the hinged front surface opened upward and the hinged panel extended forward, and with the panel in its closed position in dashed lines.
Figure 3A:
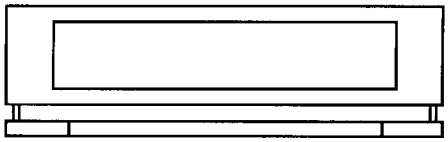
FIG. 3A to FIG. 3D are views of a preferred embodiment for the housing of the present invention.
Figure 3B:
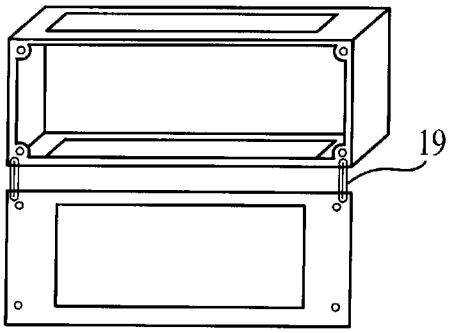
Figure 3C:
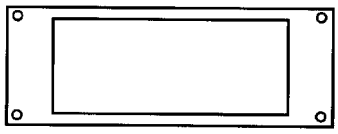
Figure 3D:
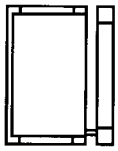

FIG. 2 is a side view taken on the line 2—2 of FIG. 1 showing the interior of the housing 10 in full lines with the front surface 13, that is connected to the top surface 11 by a front surface hinge 19, opened upward so as to allow an interior panel 20, that is connected to the interior of the bottom surface 12 by a panel hinge 21, to be extended forward in order to allow access to a first light source 16 that is mounted in the interior rear compartment area of the housing. On the interior panel is mounted a second light source 18 that illuminates the transparent front surface 13. Also shown in FIG. 2 by dashed lines is the position of the interior panel 20 in its closed position.

FIG. 3A to FIG. 3D are views of a preferred embodiment for the housing of the present invention.

In a preferred embodiment, the front surface of the interior panel 20 is made of a reflective material so as to reflect as much light as possible towards the transparent front surface 13.

In another preferred embodiment, the front surface 13 is detachably mounted to the remainder of the housing. Such a mounting can be achieved in many ways, including the use of providing the edges of the top and bottom surfaces with a number of threaded holes for receiving screws that pass through holes in the housing's front surface.

There exist many means for mounting address indicia of the housing's front surface, these include: (1) having the address indicia be fabricated in such a manner so that they possess the means (e.g., adhesive on the backside of the indicia) for securely adhering themselves to the front surface, (2) providing the front surfaces with grooves that allow thin, card-like indicia to have their edges secured in such groves, and (3) inscribing nontransparent indicia directly onto the front surface. These and others are described in detail in the earlier referenced prior art, and will not be described in further details herein.

For a first light source 16, a three and one-half inch halogen bulb of seventy-five watts or less has been found to be a suitable choice. Similarly, a six inch tubular bulb of sixty watts or less is suitable for the second light source 18 that illuminates the front surface 13.

Figure 4:
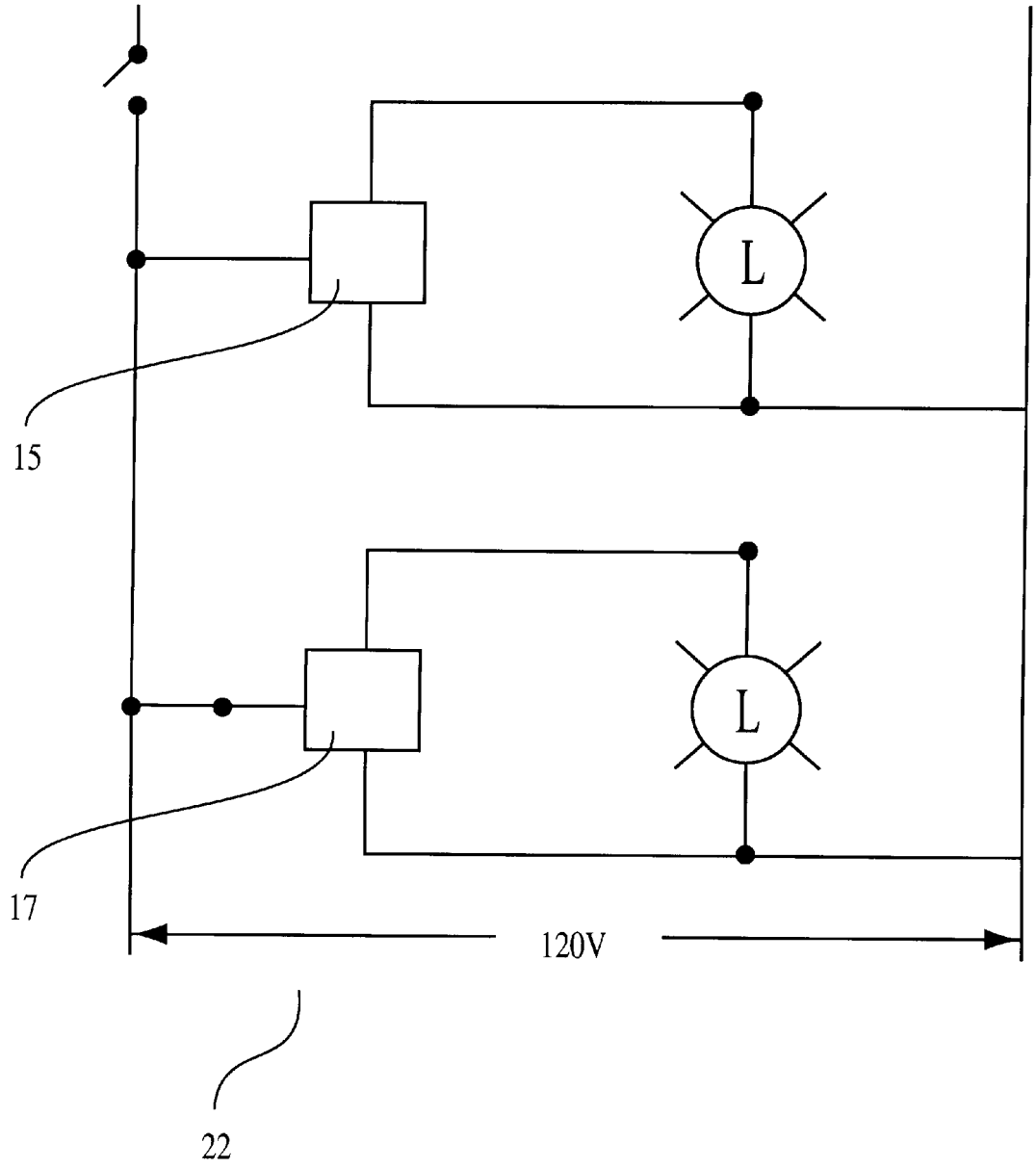
FIG. 4 is a electrical circuit control diagram for the present invention.

A suitable electrical control circuit 22 for the present invention is shown in FIG. 4. It can be powered by attachment to a standard 120 volt line voltage source.

It thus will be appreciated that a new and improved, automated, illuminated address display and entrance light is seen to achieve its object of automatically illuminating both house-identifying information and the area in the vicinity of where this information is mounted.

Although the foregoing disclosure relates to preferred embodiments of the invention, it is understood that these details have been given for the purposes of clarification only. Various changes and modifications of the inaction will be apparent, to one having ordinary skill in the art, without departing from the spirit and scope of the invention as hereinafter set forth in the claims.

I claim:

1. An automated, illuminated address display and entrance light for mounting on an exterior of and near an entrance of a building to enable a visitor during periods of darkness to locate and have the entrance to the building illuminated upon the visitor's approach to the building, said address display and entrance light comprising:

a housing having an interior panel that separates the housing into a front and a rear compartment, said housing having transparent top, bottom and front surfaces, a panel hinge attached respectively to an edge of said interior panel and an edge chosen from the group consisting of said housing bottom and top surfaces so as to allow said panel to be folded forward to allow access to the rear compartment behind the panel, a front surface hinge attached respectively to an edge of said front surface and an edge chosen from the group consisting of said housing bottom and top surfaces so as to allow said front surface to be folded outwardly thereby providing room so that said interior panel can be folded forward, a first light source mounted in said rear compartment to provide light that passes through the transparent top and bottom surfaces to illuminate an area around the housing, a second light source mounted to a front surface of said interior panel for illuminating said housing front surface, an electrical control circuit for turning on and off said first and said second lights, and address indicia on said housing transparent front surface.

2. An automated, illuminated address display and entrance light as recited in claim 1, wherein:

said control circuit includes a motion detector switch, connected to said first light source, that automatically turns on said first light source when there is a motion in a region scanned by the motion detector switch.

3. An automated, illuminated address display and entrance light as recited in claim 1, wherein:

said control circuit includes a photo cell switch, connected to said second light source, that automatically turns on said second light source in response to darkness created by the sun's setting and automatically turns off said second light source in response to a general level of illumination associated with the sun's rising.

4. An automated, illuminated address display and entrance light as recited in claim 2, wherein:

said control circuit further includes a photo cell switch, connected to said second light source, that automatically turns on said second light source in response to darkness created by the sun's setting and automatically turns off said second light source in response to a general level of illumination associated with the sun'rising.

5. An automated, illuminated address display and entrance light as recited in claim 1, wherein:

said front surface of interior panel being reflective so as to reflect light towards said housing front transparent surface.

6. An automated, illuminated address display and entrance light as recited in claim 2, wherein:

said front surface of interior panel being reflective so as to reflect light towards said housing front transparent surface.

7. An automated, illuminated address display and entrance light as recited in claim 3, wherein:

said front surface of interior panel being reflective so as to reflect light towards said housing front transparent surface.

8. An automated, illuminated address display and entrance light as recited in claim 4, wherein:

said front surface of interior panel being reflective so as to reflect light towards said housing front transparent surface.

9. An automated, illuminated address display and entrance light as recited in claim 1, wherein:

said housing has rectangular proportions with elongated top, bottom and front surfaces and further includes end surfaces and a rear surface that is mountable on an exterior of a building to be located and approached by a visitor during periods of darkness.

10. An automated, illuminated address display and entrance light as recited in claim 8, wherein:

said housing has rectangular proportions with elongated top, bottom and front surfaces and further includes end surfaces and a rear surface that is mountable on an exterior of a building to be located and approached by a visitor during periods of darkness.

11. An automated illuminated address display and entrance light for mounting on an exterior of and near an entrance of a building to enable a visitor during periods of darkness to locate and have the entrance to the building illuminated upon the visitor's approach to the building, said address display and entrance light comprising:

A housing having an interior panel that separates the housing into a front and a rear compartment, said housing having a rear surface and extending therefrom end surfaces and transparent top and bottom surfaces, a panel hinge attached respectively to an edge of said interior panel and an edge chosen from the group consisting of said housing end, bottom and top surfaces so as to allow said panel to be folded forward to allow access to the rear compartment behind the panel, a transparent housing front surface detachably mounted to said housing surfaces extending from said housing rear surface, wherein detaching said front surface provides room to allow said interior panel to be folded forward, a first light source mounted in said rear compartment to provide light that passes through the transparent top and bottom surfaces to illuminate an area around the housing, a second light source mounted to a front surface of said interior panel for illuminating said housing front surface, an electrical control circuit for turning on and off said first and said second lights, and address indicia on said housing transparent front surface.

12. An automated, illuminated address display and entrance light as recited in claim 11, wherein:

said control circuit includes a motion detector switch, connected to said first light source, that automatically turns on said first light source when there is motion in a region scanned by the motion detector switch.

13. An automated, illuminated address display and entrance light as recited in claim 11, wherein:

said control circuit includes a photo cell switch, connected to said second light source, that automatically turns on said second light source in response to darkness created by the sun's setting and automatically turns off said second light source in response to a general level of illumination associated with the sun'rising.

14. An automated, illuminated address display and entrance light as recited in claim 12, wherein:

said control circuit further includes a photo cell switch, connected to said second light source, that automatically turns on said second light source in response to darkness created by the sun's setting and automatically turns off said second light source in response to a general level of illumination associated with the sun'rising.

15. An automated, illuminated address display and entrance light as recited in claim 11, wherein:

said front surface of interior panel being reflective so as to reflect light towards said housing front transparent surface.

16. An automated, illuminated address display and entrance light as recited in claim 12, wherein:

said front surface of interior panel being reflective so as to reflect light towards said housing front transparent surface.

17. An automated, illuminated address display and entrance light as recited in claim 13, wherein:

said front surface of interior panel being reflective so as to reflect light towards said housing front transparent surface.

18. An automated, illuminated address display and entrance light as recited in claim 14, wherein:

said front surface of interior panel being reflective so as to reflect light towards said housing front transparent surface.

19. An automated, illuminated address display and entrance light as recited in claim 11, wherein:

said housing has rectangular proportions with elongated top, bottom and front surfaces, with said rear surface being mountable on an exterior of a building to be located and approached by a visitor during periods of darkness.

* * * * *